US012426744B1

(12) United States Patent
Zhang

(10) Patent No.: US 12,426,744 B1
(45) Date of Patent: Sep. 30, 2025

(54) FOLDABLE BATHTUB

(71) Applicant: Jinhua Gica Baby Products Co., Ltd., Zhejiang (CN)

(72) Inventor: Xiaoyu Zhang, Zhejiang (CN)

(73) Assignee: Jinhua Gica Baby Products Co., Ltd., Zhejiang (CN)

( * ) Notice: Subject to any disclaimer, the term of this patent is extended or adjusted under 35 U.S.C. 154(b) by 0 days.

(21) Appl. No.: 19/187,992

(22) Filed: Apr. 23, 2025

(51) Int. Cl.
*A47K 3/06* (2006.01)

(52) U.S. Cl.
CPC ..... *A47K 3/06* (2013.01)

(58) Field of Classification Search
CPC ..... A47K 3/06–074
See application file for complete search history.

(56) References Cited

U.S. PATENT DOCUMENTS 4,785,486 A * 11/1988 Viesturs ..... A47K 3/06 4/593
2011/0083262 A1* 4/2011 Barba ..... A47K 3/06 4/585

* cited by examiner

*Primary Examiner* — Christine J Skubinna
(74) *Attorney, Agent, or Firm* — Hawaii Patent Services; Nathaniel K. Fedde; Kenton N. Fedde

(57) ABSTRACT

Disclosed is a foldable bathtub, including: a bathtub body, and a temperature detection unit connected to the bathtub body. The bathtub body includes a foldable basin body formed by sequentially sealing and splicing a plurality of rigid plates and flexible plates, the foldable basin body is folded and contracted along splicing joints between the rigid plates and the flexible plates, and a direction of the folding and contraction is perpendicular to a depth direction of the bathtub body. When the bathtub body is in a contracted state, a symmetrical Z-shaped structure is formed at folding points of the basin mouth edge. The foldable bathtub enhances structural rigidity of the bathtub body and prevents collapsing and water spilling. The bathtub is folded in a direction perpendicular to the depth direction thereof, and is more compact, thereby facilitating rapid storage.

10 Claims, 3 Drawing Sheets

FOLDABLE BATHTUB

TECHNICAL FIELD

The present disclosure relates to the technical field of bathing supplies, and in particular to a foldable bathtub.

BACKGROUND

A bathtub generally has a large volume and occupies large space during transportation and storage. During transportation, substantial spatial occupation of bathtubs reduces unit shipment, thereby increasing transportation costs. Moreover, bathtubs occupy large space and waste indoor space, resulting in inconvenience to store. Bathtubs in the prior art include various structures of foldable bathtubs, but due to the need for folding, they are typically made from flexible materials. As a result, a bathtub in an unfolded state is prone to collapsing and water spilling when filled with much water. Therefore, it is urgent to design a bathtub that is foldable and has favorable structural rigidity during use.

SUMMARY

In order to overcome the defects in the prior art, the present disclosure provides a foldable bathtub, with an aim to solve the technical problem that a bathtub of the prior art fails to achieve folding and structural rigidity simultaneously.

To achieve the above objective, the present disclosure adopts the following technical solution:

In a first aspect, a foldable bathtub is provided in an example of the present disclosure, including a bathtub body, where the bathtub body includes a foldable basin body formed by sequentially sealing and splicing a plurality of rigid plates and flexible plates, the foldable basin body is folded and contracted along splicing joints between the rigid plates and the flexible plates a direction of the folding and contraction is perpendicular to a depth direction of the bathtub body; and when the bathtub body is in a contracted state, a symmetrical Z-shaped structure is formed at folding points of the basin mouth edge.

The foldable bathtub further includes two supporting mechanisms, the supporting mechanism is connected to the basin mouth edge of the bathtub body in a snap-fitted manner, and when the bathtub body is in an opened state, the supporting mechanism is connected to a basin mouth edge of the bathtub body.

The supporting mechanism includes two snap-fit members, and the two snap-fit members are oppositely arranged along edges in a length direction of the bathtub body.

A folding and contraction direction of the foldable basin body is the same as the length direction of the bathtub body.

One rigid plate is located at a center of the foldable basin body in a length direction, and the foldable basin body is symmetrically folded around the rigid plate at the center thereof. The snap-fit members are strip-shaped components with a U-shaped cross-section.

The temperature detection unit includes: a temperature sensor, a controller electrically connected to the temperature sensor, and a display screen electrically connected to the controller, where the temperature sensor is located at a bottom of the bathtub body, and the display screen is configured to display a temperature of liquid stored in the bathtub body that is detected by the temperature sensor.

The controller is embedded in the bathtub body, and the display screen is arranged at an opening edge of the bathtub body.

A drainage outlet is further arranged at the bottom of the bathtub body, and a pluggable sealing plug is arranged inside the drainage outlet.

A plurality of supporting portions that protrude in a height direction of the bathtub body are arranged at the bottom of the bathtub body.

Through combination of a foldable basin body formed by sequentially splicing the plurality of rigid plates and flexible plates with the supporting mechanism arranged in an unfolded state, the foldable bathtub of the present disclosure enhances structural rigidity of the bathtub body and prevents collapsing and water spilling. The bathtub is folded in a direction perpendicular to the depth direction thereof, and is more compact, thereby facilitating rapid storage.

The above description is merely a summary of the technical solution of the present disclosure. In order to have a clearer understanding of the technical means of the present disclosure, the content of the specification may be referred to for implementation. To make the above and other objectives, features and advantages of the present disclosure apparent and understandable, the following preferred examples are detailed as follows.

Figure 1:
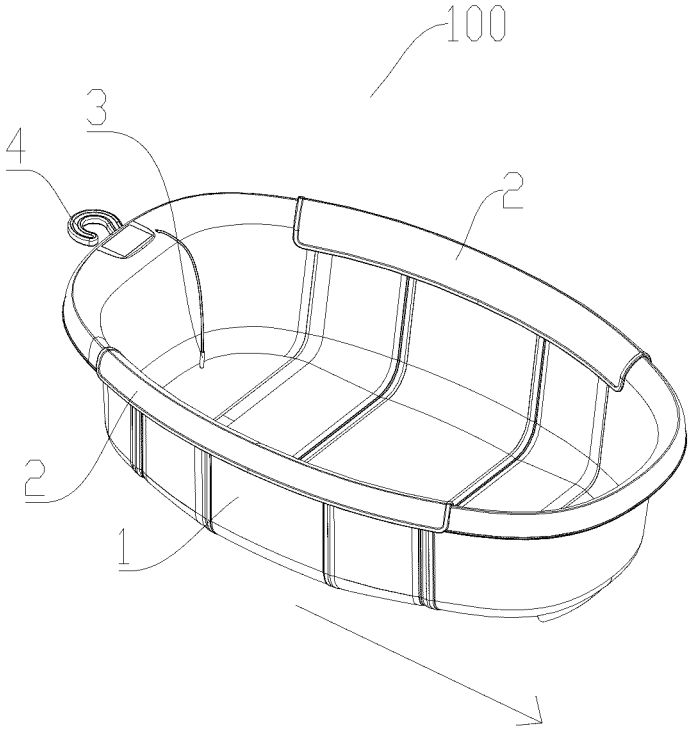
FIGS. 1-4 are structural schematic diagrams of different views of a foldable bathtub in an unfolded state according to an example of the present disclosure.
Figure 2:
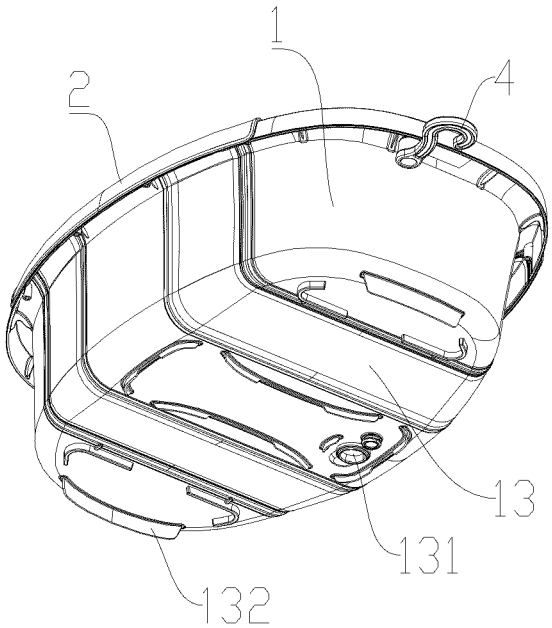

Reference numerals in the figures:

100—foldable bathtub; 1—bathtub body; 2—supporting mechanism; 3—temperature detection unit; 21—snap-fit member; 22—snap-fit member; 11—rigid plate; 12—flexible plate; 13—basin bottom; 14—longitudinal left side wall; 15—longitudinal right side wall; 121—splicing joint; 31—display screen; 32—signal cable; 33—temperature sensor; 4—hook; 5—sealing plug; 131—drainage outlet; 132—supporting portion; 121—right z-shaped folding structure; and 122—left z-shaped folding structure.

DETAILED DESCRIPTIONS OF THE EMBODIMENTS

In order to make objectives, technical solutions and advantages of the present disclosure clearer, the present disclosure will be described in further detail below with reference to the accompanying drawings and specific embodiments.

The technical solutions in the examples of the present disclosure will be clearly and completely described below in combination with the accompanying drawings in the examples of the present disclosure. Apparently, the examples described are merely some rather than all of the examples of the present disclosure. Based on the examples of the present disclosure, all other examples obtained by those skilled in the art without making creative efforts shall fall within the protection scope of the present disclosure.

In the description of the present disclosure, it is to be understood that the terms "central", "longitudinal", "transverse", "length", "width", "thickness", "upper", "lower", "front", "rear", "left", "right", "vertical", "horizontal", "top", "bottom", "inner", "outer", "clockwise", "counterclockwise", etc. indicate azimuthal or positional relations based on those shown in the accompanying drawings only for ease of description of the present disclosure and for simplicity of description, and are not intended to indicate or imply that the referenced device or element must have a particular orientation and be constructed and operative in a particular orientation, and thus may not be interpreted as a limitation on the present disclosure.

Furthermore, the terms "first" and "second" are merely for the purpose of description, and cannot be construed as indicating or implying relative importance or implicitly specifying the number of technical features indicated. Thus, a feature defined with "first" and "second" may explicitly or implicitly include one or more of the features. In the description of the present disclosure, "a plurality of" means two or more, unless expressly specified otherwise.

In the present disclosure, unless otherwise explicitly specified and defined, the terms "mounting", "connecting", "connection", "fixing", etc. should be understood in a broad sense, for example, they may be a fixed connection, a detachable connection, or an integrated connection; may be a mechanical connection, or an electrical connection; may be a direct connection, or an indirect connection via an intermediate medium; and may be communication inside two elements, or an interactive relation between two elements. For those skilled in the art, the specific meanings of the terms described above in the present disclosure may be interpreted according to specific circumstances.

In the present disclosure, unless otherwise expressly stated and defined, a first feature being "above" or "below" a second feature may include the first and second features being in direct contact or that the first and second features being not in direct contact but being in contact by means of additional features between the first and second features. In addition, the first feature being "over", "above" and "on the top of" the second feature includes that the first feature is over and above the second feature, or simply means that the level of the first feature is higher than that of the second feature. The first feature being "under", "below" and "at the bottom of" the second feature includes that the first feature is under and below the second feature, or simply means that the level of the first feature is lower than that of the second feature.

In the description of the present description, the description of reference terms such as "one embodiment", "some embodiments", "example", "specific example" or "some examples" means that specific features, structures, materials or characteristics described in combination with the embodiment or example are included in at least one embodiment or example of the present disclosure. In the present description, the schematic description of the above terms should not be construed as necessarily referring to the same embodiment or example. Moreover, the specific features, structures, materials or characteristics described may be combined in a suitable manner in any one or more embodiments or examples.

A bathtub generally has a large volume and occupies large space during transportation and storage. During transportation, substantial spatial occupation of bathtubs reduces unit shipment, thereby increasing transportation costs. Moreover, bathtubs occupy large space and waste indoor space, resulting in inconvenience to store. Bathtubs in the prior art include various structures of foldable bathtubs, but due to the need for folding, they are typically made from flexible materials. As a result, a bathtub in an unfolded state is prone to collapsing and water spilling when filled with much water. Additionally, a bathtub in the prior art is generally folded in a depth direction, and still large lateral dimensions lead to an undesired storage effect. Therefore, it is urgent to design a bathtub that is foldable and has favorable structural rigidity and compactness during use. Therefore, in view of the above situation, a foldable bathtub 100 is provided in this example.

With reference to FIGS. 1-5, a foldable bathtub 100 is disclosed in this example, including: a bathtub body 1, and two supporting mechanisms 2 and a temperature detection unit 3 connected to the bathtub body 1.

The bathtub body 1 includes a foldable basin body formed by sequentially sealing and splicing a plurality of rigid plates 11 and flexible plates 12, and the foldable basin body is folded and contracted along splicing joints 121 between the rigid plates 11 and the flexible plates 12; and a direction of the folding and contraction is perpendicular to a depth direction of the bathtub body 1, that is, the bathtub body 1 is folded in a width direction of an opening thereof, and compared to designs of the prior art that a bathtub is folded for storage in a depth direction, this design of the present disclosure has a smaller storage size.

The supporting mechanism 2 is detachably connected to an edge of the bathtub body 1, and when the bathtub body 1 is in an opened state, the supporting mechanism 2 is connected to a basin mouth edge of the bathtub body 1 to enhance structural rigidity of the bathtub body 1 and prevent collapsing and water spilling.

Figure 6:
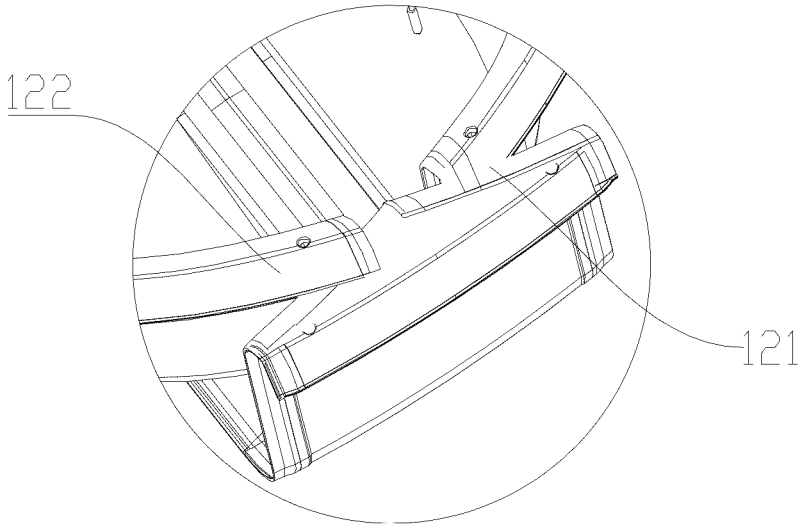
FIG. 6 is a structural schematic diagram of a partial folding position of a foldable bathtub according to an example of the present disclosure.

When the bathtub body 1 is in a folded and contracted state, a symmetrical Z-shaped structure is formed at folding points of the basin mouth edge. As shown in FIG. 6, in this state, a folding position refers to a middle position of the basin mouth edge in a length direction of the opening of the bathtub body 1. The bathtub body 1 is synchronously folded and contracted towards a middle from both left and right sides, and therefore the folding and contraction position is in the middle. In this case, a Z-shaped symmetrical folding structure is formed at the folding position, and the Z-shaped symmetrical folding structure ensures simple folding and contraction of the bathtub body 1, which facilitates processing. Specifically, a left Z-shaped folding structure 122 and a right Z-shaped folding structure 121 are formed when the bathtub body is folded from left and right sides, and the left Z-shaped folding structure 122 and the right Z-shaped folding structure 121 are symmetrically distributed in a width direction of the bathtub body 1.

The temperature detection unit 3 is configured to detect a temperature of water inside the bathtub body 1. The supporting mechanism 2 is configured to enhance edge rigidity thereof when the bathtub body 1 is unfolded for use. It is to be noted that in this example, the bathtub body 1 is presented in the form of bathtub, but a foldable appliance with the supporting mechanism 2 is not limited to the bathtub, and may include any other liquid-containing container, such as a bucket or a basin.

The supporting mechanism 2 is connected to the basin mouth edge of the bathtub body 1 in a snap-fitted manner. Of course, in other examples, the supporting mechanism 2 is alternatively detachably connected to the basin mouth edge of the bathtub body 1 in any other way. Furthermore, the supporting mechanism 2 is not limited to being connected to the opening edge of the bathtub body 1, and is alternatively connected to a side wall of the bathtub body 1.

Figure 3:
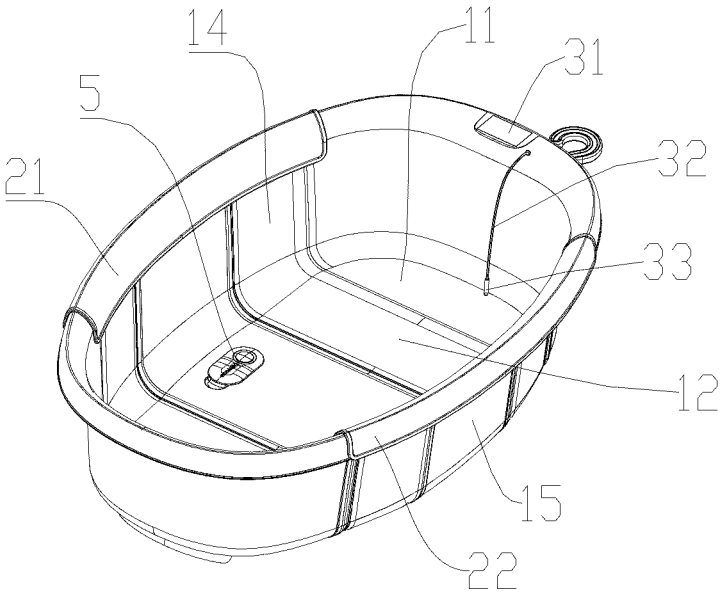
Figure 4:
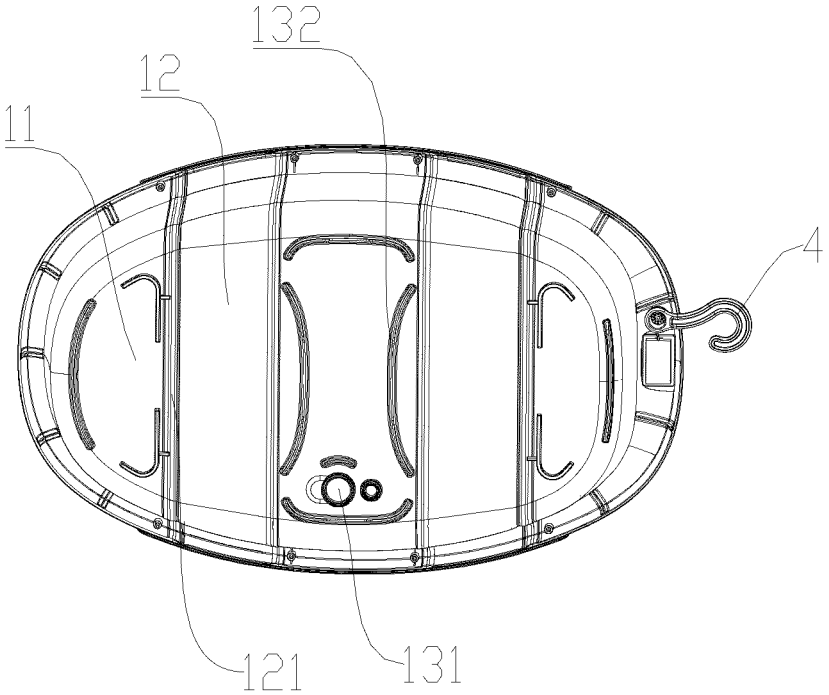

In this example, as shown in FIG. 3, the supporting mechanism 2 includes a snap-fit member 21 and a snap-fit member 22, and the snap-fit member 21 and the snap-fit member 22 are oppositely arranged along edges in a length direction of the bathtub body 1. Specifically, the snap-fit member 21 is connected to a longitudinal left side wall 14 of the bathtub body 1, and the other snap-fit member 22 is connected to a longitudinal right side wall 15.

Figure 5:
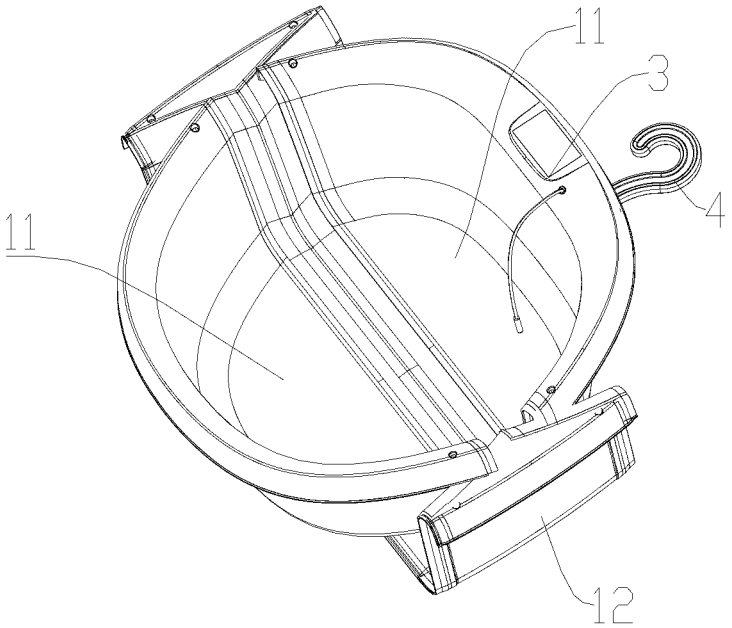
FIG. 5 is a structural schematic diagram of a foldable bathtub in a folded state according to an example of the present disclosure.

As shown in FIG. 1, the length direction of the bathtub body 1 is indicated by an arrow therein, and a folding and contraction direction of the foldable basin body is the same as the length direction of the bathtub body 1, that is, the bathtub body 1 is folded and contracted in the length direction. A unfolded state is shown in FIG. 1, and a folded state is shown in FIG. 5.

One rigid plate 11 is located at a center of the foldable basin body in a length direction, and the foldable basin body is symmetrically folded around the rigid plate at the center thereof. Further, to enhance overall structural rigidity of the bathtub body 1, plates arranged at ends of the bathtub body 1 in the length direction are all the rigid plates 11. The rigid plate 11 at the center minimizes a folding volume of the bathtub body 1. The flexible plates 12 and the rigid plates 11 are arranged sequentially on two sides of the bathtub body 1 around the rigid plate 11 at the center.

In this example, the snap-fit member 21 and the snap-fit member 22 are strip-shaped components with a U-shaped cross-section. Edges of the bathtub body 1 are flanged edges curved outward, the U-shaped strip-shaped components are elastically snap-fitted with the flanged edges, and the supporting mechanism 2 and the bathtub body 1 are assembled and disassembled easily due to a simple structure and connection method.

With reference to FIG. 3 again, the temperature detection unit 3 includes: a temperature sensor 33, a controller electrically connected to the temperature sensor 33, and a display screen 31 electrically connected to the controller, where the temperature sensor 33 is located at a bottom of the bathtub body 1, and the display screen 31 is configured to display a temperature of liquid stored in the bathtub body 1 that is detected by the temperature sensor 33. The controller is connected to the temperature sensor 33 through a flexible signal cable 32.

Specifically, the controller is embedded in the bathtub body 1, and the display screen 31 is arranged at the opening edge of the bathtub body 1.

A drainage outlet 131 is further arranged at a basin bottom 13 of the bathtub body 1, and a pluggable sealing plug 5 is arranged inside the drainage outlet 131. The sealing plug 5 is inserted into the drainage outlet 131, and the bathtub body 1 contains water or any other liquid, and when the sealing plug 5 is removed, liquid inside the bathtub body 1 is discharged.

With reference to FIG. 2 again, a plurality of supporting portions 132 that protrude in a height direction of the bathtub body 1 are arranged at the basin bottom 13 of the bathtub body 1, and the supporting portions 132 enhance support stability.

A movable hook 4 is further arranged at the opening edge of the bathtub body 1 at a longitudinal end, and the bathtub, through the hook 4, may be vertically hung on a wall and other equivalent structures.

Through combination of a foldable basin body formed by sequentially splicing the plurality of rigid plates and flexible plates with the supporting mechanism arranged in an unfolded state, the foldable bathtub in this example enhances structural rigidity of the bathtub body and prevents collapsing and water spilling.

The above examples are only intended to further illustrate the technical content of the present disclosure and facilitate understanding by the readers, but it does not mean that the embodiments of the present disclosure are only limited thereto. Any technical extension or recreation made based on the present disclosure falls within the scope of protection of the present disclosure. The scope of protection of the present disclosure shall be governed by the appended claims.

What is claimed is:

1. A foldable bathtub, comprising a bathtub body, wherein the bathtub body comprises a foldable basin body formed by sequentially sealing and splicing a plurality of rigid plates and flexible plates, the foldable basin body is folded and contracted along splicing joints between the rigid plates and the flexible plates, and a direction of the folding and contraction is perpendicular to a depth direction of the bathtub body; and when the bathtub body is in a contracted state, a symmetrical Z-shaped structure is formed at folding points of the basin mouth edge.

2. The foldable bathtub according to claim 1, wherein the foldable bathtub further comprises two supporting mechanisms, the supporting mechanism is connected to the basin mouth edge of the bathtub body in a snap-fitted manner, and when the bathtub body is in an opened state, the supporting mechanism is connected to a basin mouth edge of the bathtub body.

3. The foldable bathtub according to claim 2, wherein the supporting mechanism comprises two snap-fit members, and the two snap-fit members are oppositely arranged along edges in a length direction of the bathtub body.

4. The foldable bathtub according to claim 3, wherein a folding and contraction direction of the foldable basin body is the same as the length direction of the bathtub body.

5. The foldable bathtub according to claim 4, wherein one rigid plate is located at a center of the foldable basin body in a length direction, and the foldable basin body is symmetrically folded around the rigid plate at the center thereof.

6. The foldable bathtub according to claim 3, wherein the snap-fit members are strip-shaped components with a U-shaped cross-section.

7. The foldable bathtub according to claim 2, wherein the foldable bathtub further comprises a temperature detection unit connected to the bathtub body, and the temperature detection unit comprises: a temperature sensor, a controller electrically connected to the temperature sensor, and a display screen electrically connected to the controller, wherein the temperature sensor is located at a bottom of the bathtub body, and the display screen is configured to display a temperature of liquid stored in the bathtub body that is detected by the temperature sensor.

8. The foldable bathtub according to claim 7, wherein the controller is embedded in the bathtub body, and the display screen is arranged at an opening edge of the bathtub body.

9. The foldable bathtub according to claim 8, wherein a drainage outlet is further arranged at the bottom of the bathtub body, and a pluggable sealing plug is arranged inside the drainage outlet.

10. The foldable bathtub according to claim 9, wherein a plurality of supporting portions that protrude in a height direction of the bathtub body are arranged at the bottom of the bathtub body.

* * * * *